United States Patent [19]

Barrow

[11] 4,079,897

[45] Mar. 21, 1978

[54] SPOOL WEIGHT

[76] Inventor: Edward M. Barrow, 108 W. 57th St., New York, N.Y. 10019

[21] Appl. No.: 696,797

[22] Filed: Sep. 27, 1976

[51] Int. Cl.[2] ..... B65H 49/00

[52] U.S. Cl. ..... 242/129.8; 242/147 R

[58] Field of Search ..... 242/129.8, 156, 156.1, 242/156.2, 147 R; 156/221, 222

[56] References Cited

U.S. PATENT DOCUMENTS

| | | | |
|---|---|---|---|
| 799,632 | 9/1905 | Catterall | 242/156 |
| 2,680,931 | 6/1954 | Champion | 45/68.4 |
| 3,105,787 | 10/1963 | Carpenter, Sr. et al. | 156/222 |

*Primary Examiner*—Leonard D. Christian

*Attorney, Agent, or Firm*—Flynn & Frishauf

[57] ABSTRACT

A spool weight comprising a metal weight member which is secured to an upper surface of a spool by means of a double sided adhesive disc, the metal weight member and the adhesive disc having apertures therein which are in alignment with the elongated aperture of the thread spool.

2 Claims, 1 Drawing Figure

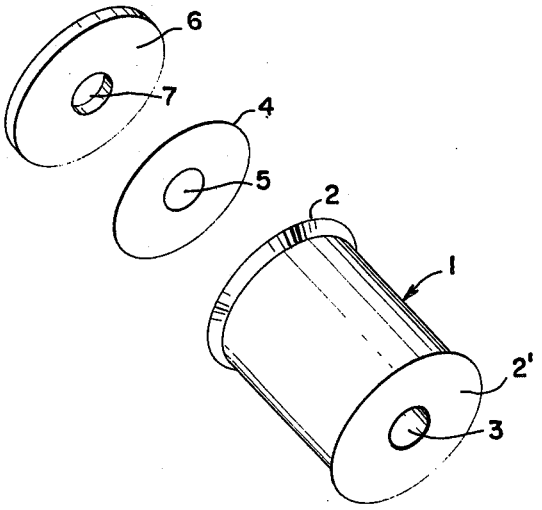
6
7
4
5
2
1
2'
3

SPOOL WEIGHT

The present invention relates to a weighted thread spool, and more particularly, to a thread spool with a weight, such as a metal disc, adhesively secured thereto.

Many present thread spools are being made of lightweight materials such as plastic. These lightweight spools have a tendency to fly upwardly on the spool spindle of a sewing machine when the operator sews rapidly. The object of the present invention is to provide a spool weight arrangement which will effectively weigh the spool down enough so that the tendency of the spool to fly upwardly will no longer exist.

BRIEF DESCRIPTION OF THE DRAWING

The single FIGURE illustrates a thread spool and weight arrangement according to the present invention.

DETAILED DESCRIPTION

Referring to the single FIGURE, a spool 1 having thread (not shown) wound thereon has upper and lower substantially flat end surfaces 2, 2' and an elongated aperture 3 extending therethrough. The elongated aperture 3 is adapted to be engaged by a vertical spindle of a sewing machine and the thread (not shown) wound on the spool is adapted to be tangentially payed out. A sheet of adhesive 4, in the form of a disc, is provided which has adhesive on both flat surfaces thereof. The disc-shaped sheet of adhesive 4 has a central opening 5 therethrough which is adapted to be in registration with the aperture 3 of the spool when the sheet of adhesive is adhered to a flat end surface of the spool 1.

A metal disc-shaped weight member 6 with a central opening 7 therethrough serves as the weight member for the spool 1. The metal disc 6 is adhered to the flat end surface of the spool 1 by means of the double faced adhesive sheet 4 with the hole 7 of the metal disc 6 in registration with the elongated aperture 3 of the spool. The resultant structure, with the metal disc-shaped weight 6 adhered to the flat end surface 2 of the spool via the adhesive member 4 comprises a weighted thread spool according to the present invention.

Various modifications and alterations can be made to the illustrated embodiment within the scope of the appended claims.

What is claimed:

1. A thread spool arrangement comprising:

a lightweight thread spool with an elongated extending therethrough, said thread spool being adapted to rotate about the longitudinal axis of said elongated aperture to tangentially pay out thread, said thread spool having substantially flat end surfaces lying in a plane substantially perpendicular to said elongated aperture, said end surfaces each having a substantially round periphery;

a substantially flat metal weight member having a central opening, said weight member having a size which is not greater than the size of said substantially flat end surfaces of said thread spool; and a sheet of material having opposing adhesive surfaces for securing said metal weight member to one of said end surfaces of said thread spool with the opening of said weight member in registration with said elongated aperture of said thread spool, said sheet having an opening through a central portion thereof which is adapted to be in registration with both said elongated aperture of said thread spool and said opening of said weight member;

whereby said weight member prevents said thread spool from rising when paying out thread, and further prevents said thread spool from spilling out thread due to continued rotation of said thread spool when paying out of said thread is stopped.

2. A thread spool arrangement according to claim 1 wherein said substantially flat weight member has a substantially round periphery having a diameter not greater than that of said end surfaces of said thread spool, and said adhesive sheet has a round periphery with a diameter which is not greater than that of said weight member.

* * * * *

UNITED STATES PATENT AND TRADEMARK OFFICE

CERTIFICATE OF CORRECTION

PATENT NO. : 4,079,897

DATED : March 21, 1978

INVENTOR(S) : Edward M. BARROW

It is certified that error appears in the above-identified patent and that said Letters Patent are hereby corrected as shown below:

On the initial page of the patent, change the inventor's address to:

315 West 70th Street
New York, N. Y. 10023

Signed and Sealed this

*Fourth* Day of *July 1978*

[SEAL]

*Attest:*

RUTH C. MASON
*Attesting Officer*

DONALD W. BANNER
*Commissioner of Patents and Trademarks*